US006773331B1

(12) United States Patent
Weiser

(10) Patent No.: US 6,773,331 B1
(45) Date of Patent: Aug. 10, 2004

(54) NOVELTY WITH INCORPORATED FAN

(75) Inventor: Margaret Weiser, Tarzana, CA (US)

(73) Assignee: Exhart Environmental Systems, Inc., Chatsworth, CA (US)

( * ) Notice: Subject to any disclaimer, the term of this patent is extended or adjusted under 35 U.S.C. 154(b) by 0 days.

(21) Appl. No.: 10/646,563

(22) Filed: Aug. 21, 2003

(51) Int. Cl.[7] ..... A63H 33/00

(52) U.S. Cl. ..... 446/491; 446/217; 40/479; D21/458

(58) Field of Search ..... 446/217, 218, 446/491; 40/479; D21/458

(56) References Cited

U.S. PATENT DOCUMENTS

| | | | | | |
|---|---|---|---|---|---|
| 1,433,098 | A | * | 10/1922 | Reynolds et al. | 446/218 |
| 1,538,562 | A | | 5/1925 | Koshalko | |
| 1,910,923 | A | | 5/1933 | Kerr | |
| D224,549 | S | * | 8/1972 | Kroll | D21/458 |
| 4,108,535 | A | * | 8/1978 | Slaughter | 359/525 |
| 4,582,497 | A | | 4/1986 | Lyons | 446/217 |
| 5,350,332 | A | * | 9/1994 | Yu et al. | 446/217 |
| 5,971,828 | A | | 10/1999 | Lin | 446/217 |
| 6,082,868 | A | * | 7/2000 | Carpenter | 362/96 |
| 6,206,747 | B1 | | 3/2001 | Skwarek | 446/217 |
| 6,364,732 | B1 | | 4/2002 | Wu | 446/217 |
| 6,422,913 | B1 | * | 7/2002 | Trejo | 446/217 |
| 6,475,056 | B1 | | 11/2002 | Christianson | 446/201 |

* cited by examiner

*Primary Examiner*—Derris H. Banks
*Assistant Examiner*—Ali Abdelwahed
(74) *Attorney, Agent, or Firm*—Cislo & Thomas LLP

(57) ABSTRACT

A novelty comprising a fan member defining an enclosure and having at least one support to the rotably mount a fan which is of lightweight construction and which rotatively moves to fluid impingement thereon such as from air and wherein the fan member is of see through material so that the fan is visible to an observer.

10 Claims, 5 Drawing Sheets

NOVELTY WITH INCORPORATED FAN

BACKGROUND OF THE INVENTION

1. Field of the Invention

This invention relates to novelties of the type that may be used outdoors and having an active aspect such as a fan or spinner that is acted upon by the wind.

2. Description of the Related Art

The prior art includes a number of novelty items having what may be considered fans or pinwheel components but none has incorporated a unique fan structure defining to an enclosure having at least one support to rotatably mount the fan and wherein the fan is of lightweight material so that it is rotatably supported from at least one support and is adapted to rotatably move subject to fluid impingement thereon such as from the wind and wherein the central fan member is fabricated in such a manner as to be visibly discernable when incorporated in or with a whimsical, ornamental representation of an animal, insect, bird or the like.

DESCRIPTION OF THE PREFERRED EMBODIMENT(S)

Figure 1:
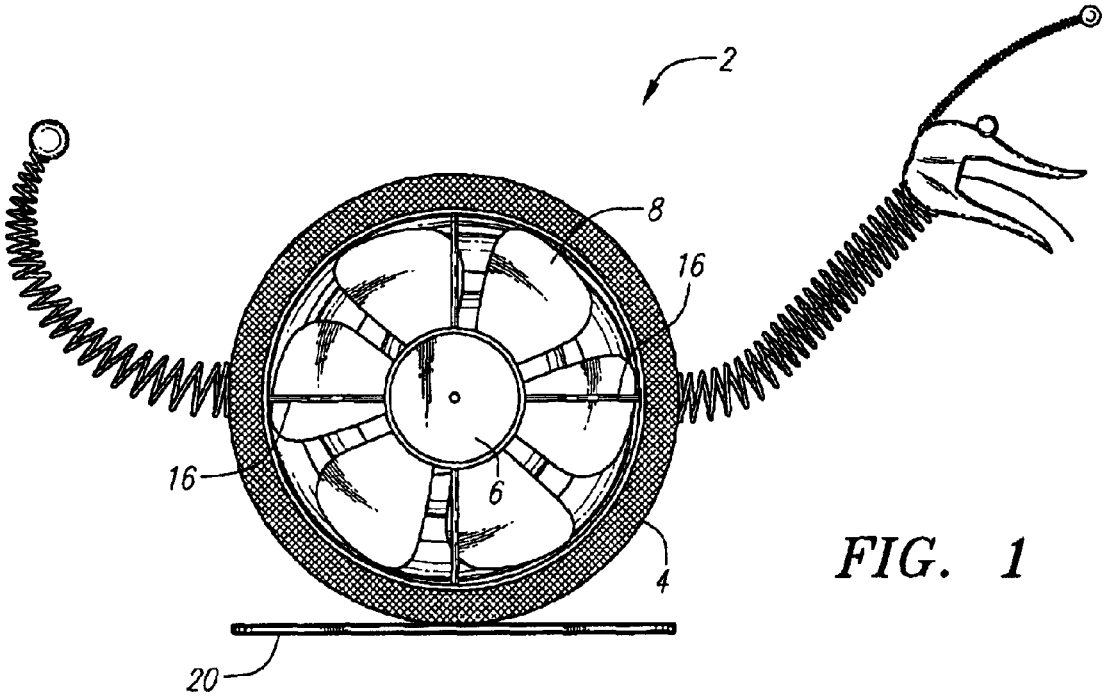
FIG. 1 is an elevational view of one embodiment of the present invention.
Figure 2:
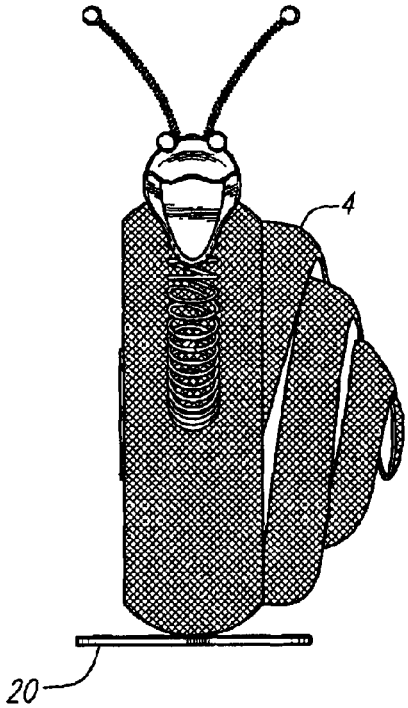
FIG. 2 is a front view of the embodiment depicted in FIG. 1.
Figure 3:
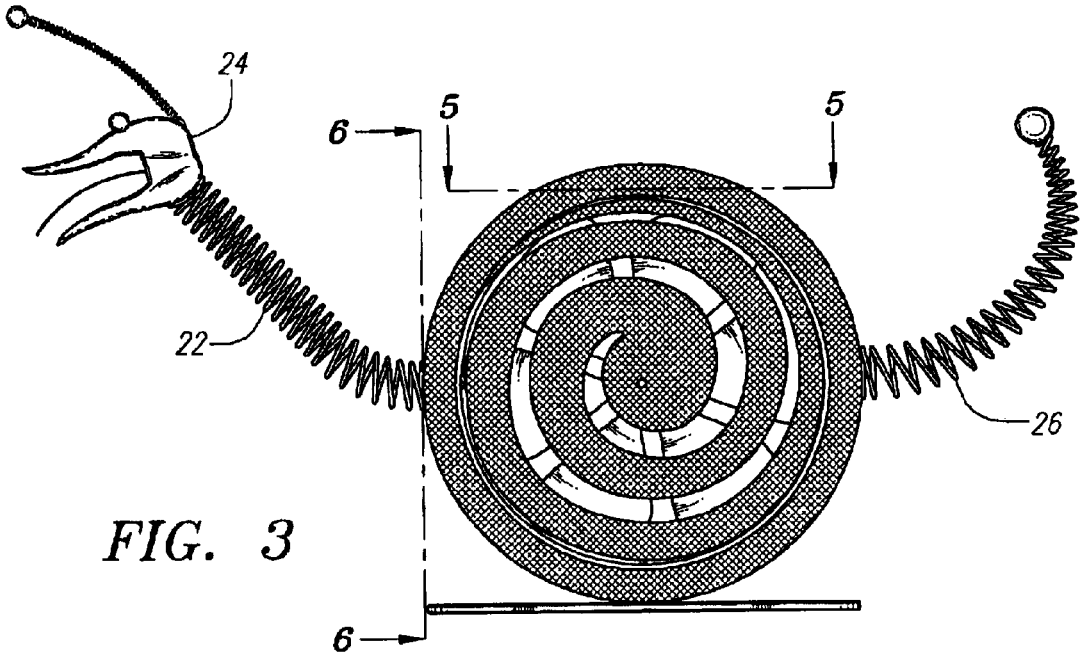
FIG. 3 is another elevational view of the embodiment depicted in FIG. 1.
Figure 4:
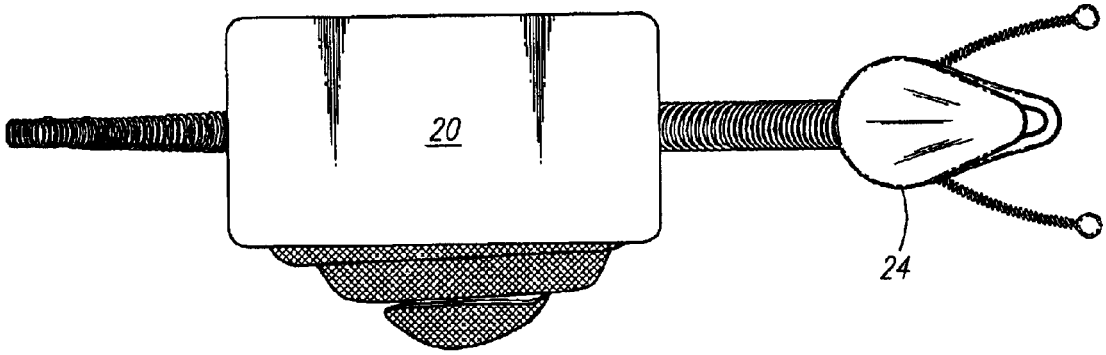
FIG. 4 is a top view of the embodiment depicted in FIG. 1.
Figure 5:
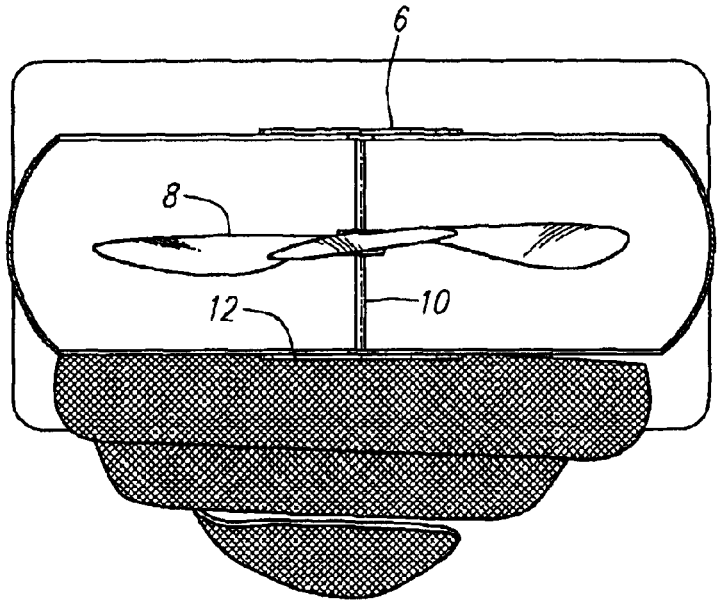
FIG. 5 is a view taken along the line 5—5 of FIG. 3.
Figure 6:
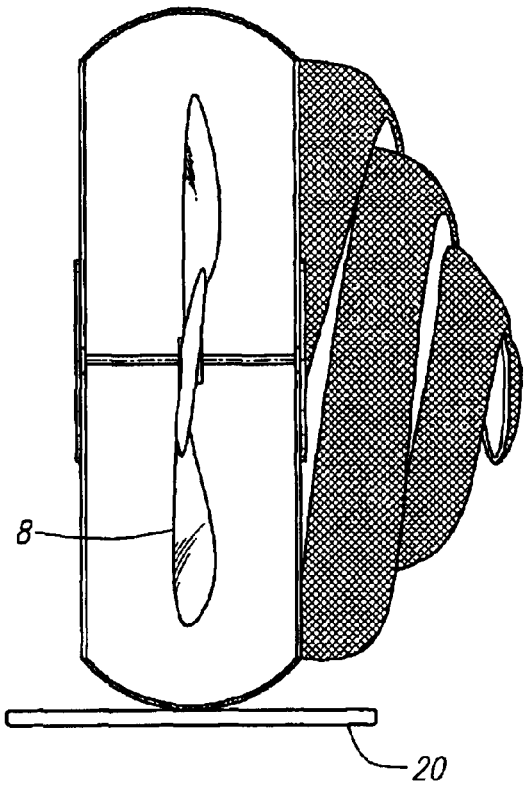
FIG. 6 is a view taken along the line 6—6 of FIG. 3.
Figure 7:
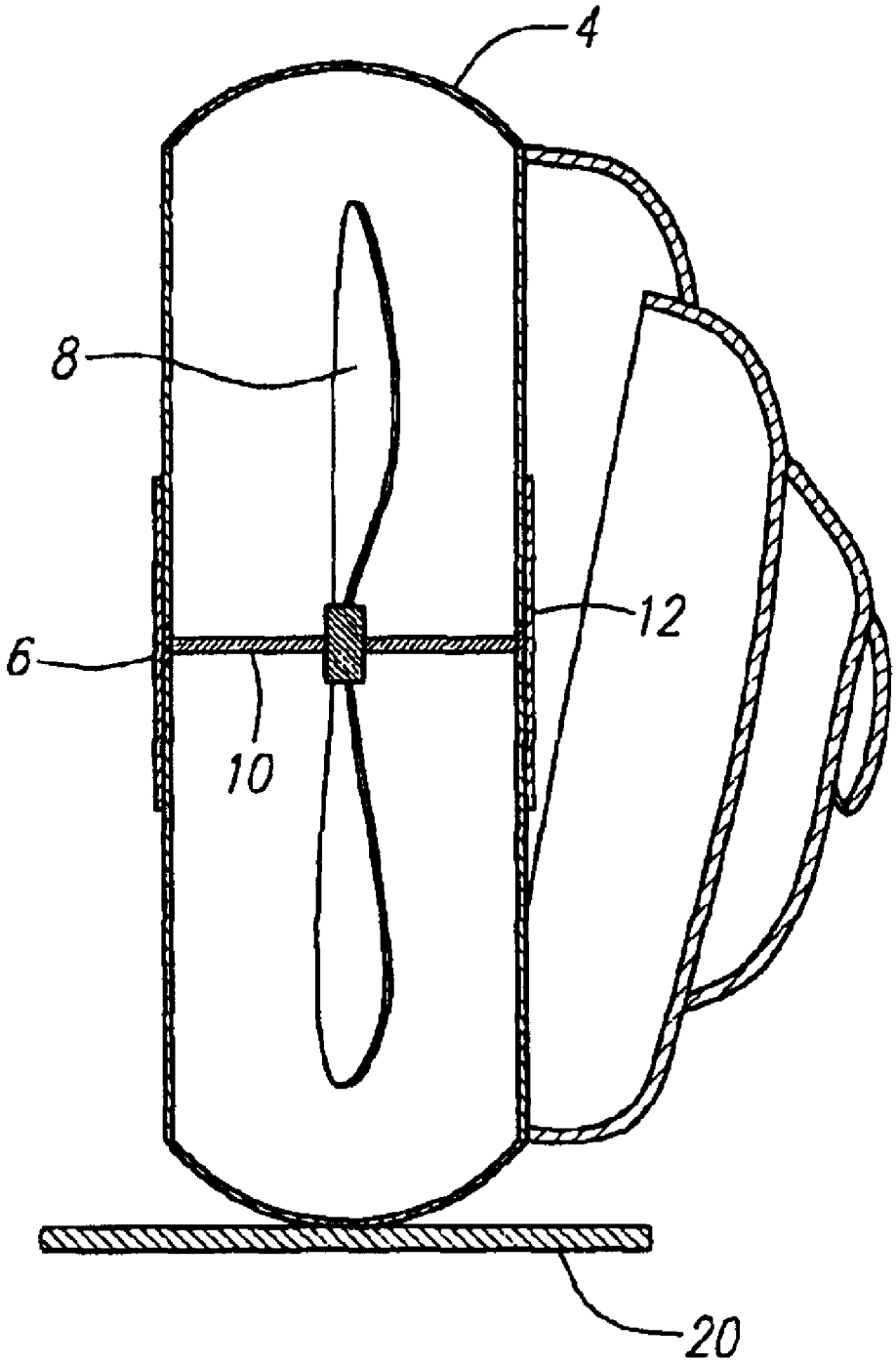
FIG. 7 is an enlarged, broken-away view showing how the rotating member of the invention is supported.

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention and the claims thereof. In other words, while the figures disclose certain animals in whimsical caricature form, it should be understood that other animals, fish, insects and the like are contemplated and same indeed are intended to be covered by the appended claims. These and other changes and modifications will make themselves apparent to those of ordinary skill in the art and also its changes and modifications will need not in fact detract from the broad interpretations of the claims.

Referring to the figures of drawing wherein like numerals of reference designate like elements throughout it will be seen that novelty 2, here taking the configuration of a whimsical animal such as a snail, comprises a central fan member 4 defining a body representative of the snail and having at least one support 6 for rotatably supporting a pinwheel or fan member 8 by reason of axle or rod 10. An additional support 12 that is spaced apart and opposed to support 6 may be utilized so as to better support the fan 8 which is made of lightweight material, in this case being plastic or the like.

Opposed supports 6 and 12 are supported by radial supports 16 in order to lend stability to the structure.

Novelty 2 may have a support member such as plate 20 which supports the novelty 2 for placement on a surface such as grass, concrete or the like in ideally a position where the fan member 8 will be subjected to wind forces to thereby rotate the same to give dynamics or dynamism to novelty 2.

In this particular instance the body 4 is made up of a see through mesh-like material so that the rotating fan 8 may be viewed from various points of view of the novelty 2.

In many instances the novelty 2 will have general appendages that may be associated with the animal, insect, fish or the like being characterized and thus a spring neck 22 is secured by welding or the like to structure making up the body 4. Also attached to neck 22 is head 24 with an opposed tail 26, it being understood that the novelties being depicted are wholly whimsical in nature and thus free license may be taken with respect to depicting in various forms the appendages that one would like to associate with animals, fish or insects.

Figure 8:
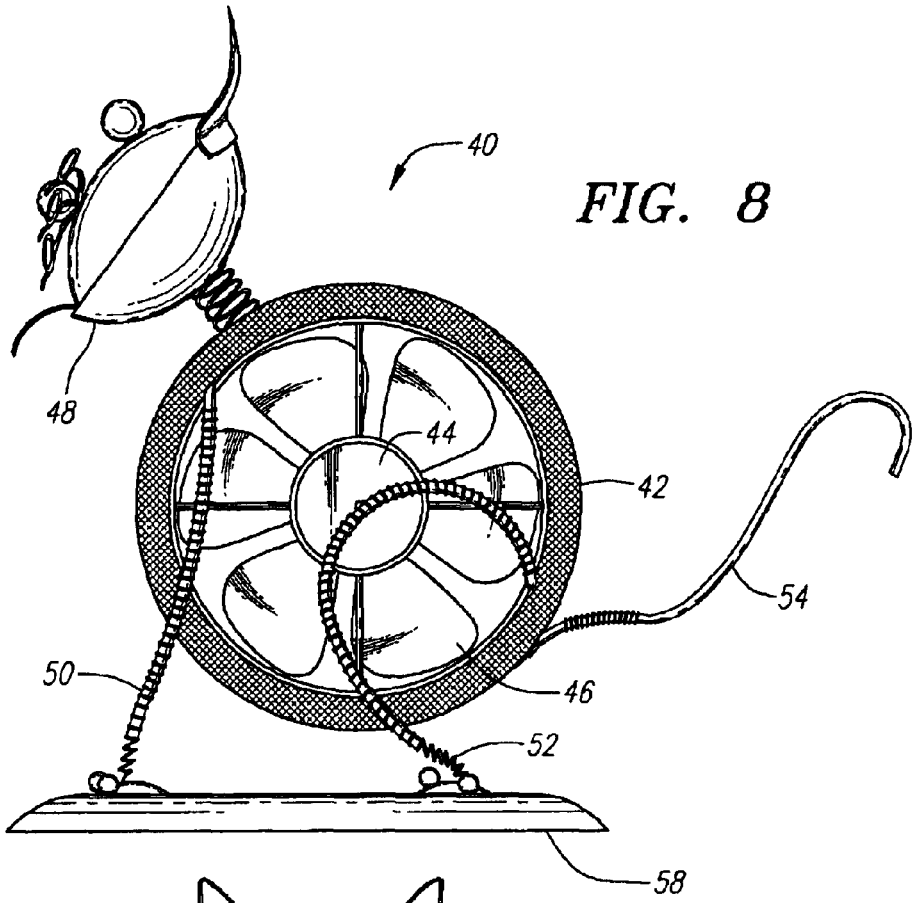
FIG. 8 is an elevational view of another alternate embodiment of the invention.
Figure 9:
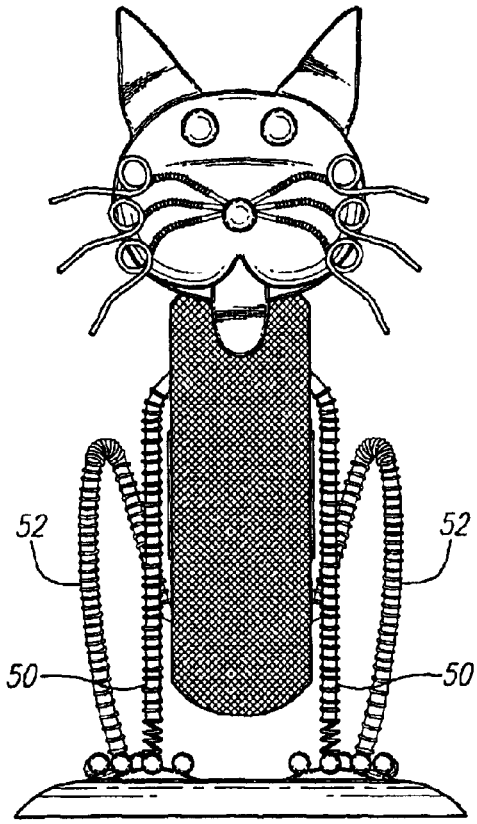
FIG. 9 is a front view of the FIG. 8 embodiment.

In referring to FIGS. 8 and 9 there is seen another embodiment of the invention 40 here taking the configuration of a whimsical cat 40. As earlier described with respect to the novelty 2, the cat 40 has a central fan member 42 defining a body representative of an animal such as a cat or the like and has at least one support 44 to support in rotatably mounted fashion a lightweight fan member 46 wherein the fan 46 is adapted to rotatably move subject to fluid impingement thereon. Also included is a head member such as 48 representative of the cat 40 and of course other appendages such as the legs 50 and 52 may be utilized of various construction here shown as being of wire with of course the ubiquitous cat tail 54. It will be noted that attached to each of the legs 50 and 52 is a stand or support member 58 for supporting the novelty 40. Obviously, other support members may be utilized such as garden stakes or the like.

It should be noted that the body member 42 here again is of a see-through construction, whether mesh or otherwise so as to allow visual observance of the fan member 46 upon rotational movement in a garden setting or the like.

Various materials of construction may be utilized, but in the preferred form a light wire mesh has been found to be ideal for the body to be representative of the animal or the like comprising the novelty with lightweight plastic or metal for the fan member with metal or other material of construction for the appendages as well as head and tail members.

It should be understood that the main and central aspect of the invention comprises a novelty having a fan member defining an enclosure and having at least one support to rotatably mount a fan, the fan being of lightweight material so as to be adapted to rotatably move subject to fluid impingement thereon and wherein the central fan member is fabricated of a see-through material whether it be wire mesh or otherwise and wherein the novelty may be supported from a plate, stake or other means of support, the variety and configurations of same will make themselves readily apparent to those of ordinary skill in the art.

Additionally, while the novelty items have been shown and depicted of certain animal species, it is intended also to be applicable to insects, fish and the like and it is also contemplated that the fan member defining the enclosure be separate and apart and not necessarily all encompassing of the creature to be depicted in a whimsical manner.

While specific materials of construction and configurations have been disclosed, those of ordinary skill in the art will at once recognize that various modifications are indeed possible as are various means of supporting the central fan member and same lends itself to being adapted to various depictions or utilized with various other novelties in a manner that is consistent with providing dynamic entertainment in a garden, deck, porch or the like environment and all such changes and modifications are intended to be covered by the appended claims.

While the present invention has been described with regards to particular embodiments, it should be recognized that additional variations of the present invention may be devised without departing from the inventive concept as disclosed herein.

What is claimed is:

1. A novelty comprising:

a central fan member defining a body representative in contour of a main body position of an animal and having at last one support to rotatably mount a fan; a lightweight fan rotatably supported from said at last one support and adapted to rotatively move subject to fluid impingement thereon and including a head member peripherally disposed relative to the body representative of a secondary body portion of the animal in whimsical configuration.

2. The novelty in accordance with claim 1 wherein an additional spaced apart support is operatively connected to said fan.

3. The novelty in accordance with claim 2 which includes at least one appendages representative of the animal.

4. The novelty in accordance with claim 3 which includes a stand operatively connected to said central fan member.

5. The novelty in accordance with claim 4 wherein said body is made of mesh material so said fall is visibly discernable.

6. A novelty of an animal having a body, said novelty comprising a fan member representative of a main body portion of the animal in contour and defining an enclosure and a head member peripherally disposed relative to the body representative of a secondary body portion of the animal, said fan member having coupled thereto at least once support to rotatably mount a fan; a light weight fan rotatably supported from said at least one support and adapted to rotatively move subject to fluid impingement thereon, said fan member being fabricated of a see-through material and including a support for said novelty.

7. The novelty in accordance with claim 6 wherein said see-through material is a mesh, and said fan member is configured to represent a body of the animal.

8. The novelty in accordance with claim 7 wherein an additional spaced-apart support is operatively connected to said fan.

9. The novelty in accordance with claim 8 wherein said fun member is centrally disposed and includes appendages representative of the animal.

10. The novelty in accordance with claim 9 wherein said support is a plate in configuration.

* * * * *

US006773331C1

(12) INTER PARTES REEXAMINATION CERTIFICATE (0307th)

United States Patent

Weiser

(10) Number: US 6,773,331 C1

(45) Certificate Issued: Oct. 4, 2011

(54) NOVELTY WITH INCORPORATED FAN

(75) Inventor: Margaret Weiser, Tarzana, CA (US)

(73) Assignee: Exhart Environmental Systems, Inc., Chatsworth, CA (US)

Reexamination Request:
No. 95/001,340, Apr. 20, 2010

Reexamination Certificate for:

| | |
|---|---|
| Patent No.: | **6,773,331** |
| Issued: | **Aug. 10, 2004** |
| Appl. No.: | **10/646,563** |
| Filed: | **Aug. 21, 2003** |

(51) Int. Cl.
*A63H 33/00* (2006.01)
*A63H 33/40* (2006.01)

(52) U.S. Cl. ..... 446/491; 40/479; 446/217; D21/458

(58) Field of Classification Search ..... 446/491
See application file for complete search history.

(56) References Cited

U.S. PATENT DOCUMENTS

| | | | |
|---|---|---|---|
| 278,461 | A | 5/1883 | Screven |
| 854,190 | A | 5/1907 | Wiedemann |
| D47,951 | S | 10/1915 | Haney |
| 1,263,838 | A | 4/1918 | Barber |
| 1,377,544 | A | 5/1921 | Angell |
| 1,591,661 | A | 6/1926 | Dinsdale |
| D70,840 | S | 8/1926 | Grove |
| 1,601,983 | A | 10/1926 | Savage |
| 1,604,510 | A | 10/1926 | Heberling |
| D71,497 | S | 11/1926 | Manning |
| D71,539 | S | 11/1926 | Youree |
| D75,038 | S | 5/1928 | Mansfield |
| D75,871 | S | 7/1928 | Reek |
| D75,908 | S | 7/1928 | Fridolph et al. |
| D83,606 | S | 3/1931 | Greenan |
| D84,022 | S | 4/1931 | Berger |
| D84,554 | S | 6/1931 | Thompson |
| 1,814,314 | A | 7/1931 | Kane et al. |
| D86,875 | S | 5/1932 | Abel |
| 1,940,490 | A | 12/1933 | Frazier |
| D131,617 | S | 3/1942 | Jacoby |
| D133,734 | S | 11/1942 | Katz |
| D138,777 | S | 9/1944 | Lewis |
| D142,968 | S | 11/1945 | Royals |
| D145,474 | S | 8/1946 | Garcia |
| D147,378 | S | 8/1947 | Rouse |
| D147,716 | S | 10/1947 | Birkhahn |
| D148,263 | S | 12/1947 | Wagner |
| D160,794 | S | 11/1950 | Levinson |
| D162,255 | S | 2/1951 | Stier |
| 2,545,801 | A | 3/1951 | Wrazen |
| D170,504 | S | 9/1953 | Lee |
| D175,662 | S | 9/1955 | Yasui |
| D176,104 | S | 11/1955 | Brooks |
| 2,729,022 | A | 1/1956 | Polk |
| D180,687 | S | 7/1957 | Flower |
| 2,817,925 | A | 12/1957 | Kelley |
| D185,075 | S | 5/1959 | Erenhouse |
| D193,015 | S | 6/1962 | Curtis |
| 3,190,035 | A | 6/1965 | Armstrong |
| 3,220,253 | A | 11/1965 | Parker |
| D206,074 | S | 10/1966 | Bayhars |

(Continued)

FOREIGN PATENT DOCUMENTS

| | | | |
|---|---|---|---|
| CN | 2052078 | U | 1/1990 |

OTHER PUBLICATIONS

"Adapt." *Merriam–Webster Online Dictionary.*2010. Meriam–Webster Online May 18, 2010 <http://www.merriam–webster.com/dictionary/adapt>.*

"Stand." *Merriam –Webster Online Dictionary.* 2010. Merriam–Webster Online. Jun. 1, 2010 <http://www.merriam–webster.com/dictionary/stand>.*

*Primary Examiner*—Sara Clarke

(57) ABSTRACT

A novelty comprising a fan member defining an enclosure and having at least one support to the rotably mount a fan which is of lightweight construction and which rotatively moves to fluid impingement thereon such as from air and wherein the fan member is of see through material so that the fan is visible to an observer.

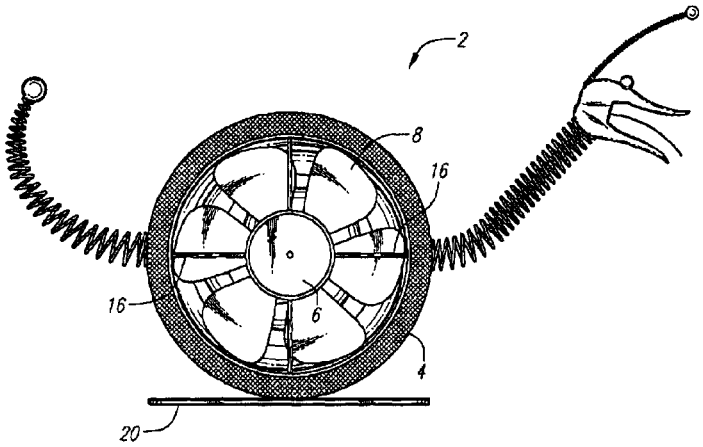

U.S. PATENT DOCUMENTS

| | | | | |
|---|---|---|---|---|
| 3,290,817 | A | | 12/1966 | Kravath |
| D213,013 | S | | 12/1968 | Klingberg |
| D224,549 | S | | 8/1972 | Kroll |
| 3,964,205 | A | | 6/1976 | Kuramochi |
| D241,461 | S | | 9/1976 | Lambert |
| D244,768 | S | | 6/1977 | Lacativo |
| 4,031,656 | A | | 6/1977 | Kupperman et al. |
| D245,365 | S | | 8/1977 | Shirashi |
| D249,028 | S | | 8/1978 | Bossons |
| D257,364 | S | | 10/1980 | Molenaar |
| D261,164 | S | | 10/1981 | Kudo |
| 4,582,497 | A | | 4/1986 | Lyons |
| D297,955 | S | | 10/1988 | Ranck |
| 4,789,801 | A | * | 12/1988 | Lee ..... 310/308 |
| D302,942 | S | | 8/1989 | Ferrero |
| D303,035 | S | | 8/1989 | O'Dunlaing |
| 4,863,413 | A | | 9/1989 | Schwarz |
| D306,203 | S | | 2/1990 | Wei |
| D317,338 | S | | 6/1991 | Peyton |
| 5,085,075 | A | | 2/1992 | Baker |
| D324,353 | S | | 3/1992 | Ursu |
| D326,148 | S | | 5/1992 | Lawlor |
| 5,205,775 | A | | 4/1993 | Brodrib |
| D337,358 | S | | 7/1993 | Orak |
| D341,402 | S | | 11/1993 | Andrews |
| 5,469,738 | A | | 11/1995 | Hendrickson |
| D370,221 | S | | 5/1996 | Firlow |
| D373,800 | S | | 9/1996 | Lance et al. |
| 5,551,923 | A | | 9/1996 | Worzella |
| 5,613,317 | A | | 3/1997 | Ninegar |
| D382,029 | S | | 8/1997 | HongCheng |
| D384,598 | S | | 10/1997 | Park |
| D385,599 | S | | 10/1997 | Stephensen et al. |
| D387,636 | S | | 12/1997 | Chang |
| 5,725,356 | A | | 3/1998 | Carter |
| D394,463 | S | | 5/1998 | Filho |
| D402,231 | S | | 12/1998 | Mumford |
| D416,047 | S | | 11/1999 | Kwok |
| D420,409 | S | | 2/2000 | Koenig |
| D425,146 | S | | 5/2000 | Shibuya |
| 6,082,868 | A | | 7/2000 | Carpenter |
| 6,095,458 | A | | 8/2000 | Cripe |
| D436,889 | S | | 1/2001 | Sheridan |
| D437,367 | S | | 2/2001 | Wang |
| D450,099 | S | | 11/2001 | Chu |
| 6,360,474 | B1 | | 3/2002 | Wurlitzer |
| D455,674 | S | | 4/2002 | Ancona |
| 6,364,732 | B1 | | 4/2002 | Wu |
| 6,374,530 | B1 | | 4/2002 | Mierau |
| D465,249 | S | | 11/2002 | Weiser et al. |
| D467,982 | S | | 12/2002 | Watson |
| D474,421 | S | | 5/2003 | Weiser |
| D483,820 | S | | 12/2003 | Weiser et al. |
| D487,714 | S | | 3/2004 | Weiser et al. |
| D499,985 | S | | 12/2004 | Weiser |
| D505,883 | S | | 6/2005 | Weiser |
| D506,951 | S | | 7/2005 | Weiser |
| 6,923,707 | B2 | | 8/2005 | Dancer |
| 2004/0126506 | A1 | | 7/2004 | Weiser |

* cited by examiner

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 5, 6 and 9 are determined to be patentable as amended.

Claims 2, 4, 7, 8 and 10, dependent on an amended claim, are determined to be patentable.

New claim 11 is added and determined to be patentable.

1. A novelty comprising:

a central fan member defining a body representative in contour of a main body [position] *portion* of an animal and having at [last] *least* one support to rotatably mount a fan; a lightweight, *axial flow* fan *within said body and having an axle with a first end and a second end, said first end and said second end of said axle each being fixed relative to said central fan member, and said lightweight fan being* rotatably supported from said at [last] *least* one support and adapted to rotatively move subject to fluid impingement thereon *in an axial direction coincident with a longitudinal axis of said axle,* and including a head member peripherally disposed relative to the body representative of a secondary body portion of the animal in whimsical configuration, *wherein said central fan member has a pair of opposing open sides to permit fluid flow in one of said opposing open sides and out the other of said opposing open sides in said axial direction and through said body, said opposing open sides each permitting said lightweight fan to be visible through said central fan member when viewed in said axial direction, said two open sides each being perpendicular to said axial direction.*

3. The novelty in accordance with claim 2 which includes at least one [appendages] *appendage* representative of the animal.

5. The novelty in accordance with claim 4 wherein said body is made of mesh material so said [fall] *fan* is visibly discernable.

6. A novelty of an animal having a body, said novelty comprising a fan member representative of a main body portion of the animal in contour and defining an enclosure and a head member peripherally disposed relative to the body representative of a secondary body portion of the animal, said fan member having coupled thereto at least [once] *one* support to rotatably mount a fan; a light weight *axial flow* fan rotatably supported from said at least one support and adapted to rotatively move subject to fluid impingement thereon, said fan member being fabricated of a see-through material and including a support for said novelty, *said fan being within said fan member and having an axle with a first end and a second end, said first end and said second end of said axle each being fixed relative to said fan member, wherein said fan member has a pair of opposing open sides to permit fluid flow in one of said opposing open sides and out the other of said opposing open sides in an axial direction coincident with a longitudinal axis of said axle and through said body, said opposing open sides each permitting said fan to be visible through said fan member when viewed in said axial direction, said two open sides each being perpendicular to said axial direction, said support for said novelty comprising a base for supporting the novelty above said base, said enclosure encircling said light weight axial flow flan in a radial direction perpendicular to said axial direction.*

9. The novelty in accordance with claim 8 wherein said [fun] *fan* member is centrally disposed and includes appendages representative of the animal.

*11. A novelty comprising:*

*a central fan member representative in contour of a main body portion of an animal and having at least one support to rotatably mount a fan;*

*a lightweight, driven, axial flow fan within said central fan member and having an axle with a first end and a second end, said first end and said second end of said axle each being fixed relative to said central fan member, and said lightweight fan being rotatably supported from said at least one support; and*

*a head member peripherally disposed relative to the central fan member and representative of a secondary body portion of the animal in whimsical configuration;*

*wherein said central fan member has a pair of opposing open sides to permit fluid flow in one of said opposing open sides and out the other of said opposing open sides through said central fan member and in an axial direction coincident with a longitudinal axis of said axle, said opposing open sides each permitting said lightweight fan to be visible through said central fan member when viewed in said axial direction, said two open sides each being perpendicular to said axial direction.*

* * * * *